United States Patent [19]

Harris et al.

[11] 4,049,028

[45] Sept. 20, 1977

[54] TRANSITION SECTION FOR A BAG FILLING DEVICE AND METHOD

[75] Inventors: Thomas C. Harris, Monroe; Charles E. DeCrane, West Monroe, both of La.

[73] Assignee: Olinkraft, Inc., West Monroe, La.

[21] Appl. No.: 670,284

[22] Filed: Mar. 25, 1976

[51] Int. Cl.[2] ..... B65B 1/06; B67D 5/06

[52] U.S. Cl. ..... 141/10; 141/93; 141/105; 141/286; 177/92; 222/533; 222/564

[58] Field of Search ..... 141/10, 54, 59, 67, 141/68, 83, 93, 94, 105, 114, 166, 248, 285, 286, 289, 313–317, 367, 392; 177/92, 93, 98, 99; 193/31 A; 222/145, 460, 533, 535, 564

[56] References Cited

U.S. PATENT DOCUMENTS

| | | | |
|---|---|---|---|
| 3,288,177 | 11/1966 | Clark | 141/248 X |
| 3,307,646 | 3/1967 | Hage | 177/98 |
| 3,908,720 | 9/1975 | Garnett | 141/286 X |

*Primary Examiner*—Richard E. Aegerter
*Assistant Examiner*—Frederick R. Schmidt
*Attorney, Agent, or Firm*—Norvell E. Von Behren; Anthony A. O'Brien; Donald W. Marks

[57] ABSTRACT

An improved transition section for a bag filling device is disclosed for use with a bag filling machine. The device comprises a new and novel transition structure that may be utilized to effectively absorb the energy of the material passing through the filling machine and to effectively control the flow of the material in the transition section so that at least two flow paths are formed within the transition chute throat section with one flow path being utilized for downwardly flow of the material being filled in the bag filling machine and the other flow path being utilized for upwardly flow of dust and air resulting from the filling process. The dual flow paths are formed by a rigid divider member fixedly attached to the control device suspended in the transition chute with the divider member moving in a generally horizontal direction in an arcuate path. The improved structure also comprises means for stopping the movement of the divider member at a predetermined position so that the path utilized for upward air flow always remains open regardless of the position of the divider and the improved structure further comprises means for removing the upwardly flowing air and dust from the transition chute. Also disclosed is a new and novel method of controlling the amount of dust in a transition section of a material packaging line whereby the dust created by the impact of the falling materials can be effectively controlled in the upper portion of the transition chute where it can be readily removed.

15 Claims, 6 Drawing Figures

TRANSITION SECTION FOR A BAG FILLING DEVICE AND METHOD

BACKGROUND OF THE INVENTION

This invention relates generally to bag filling machines and more specifically to an improved structure and method for use with a bag filling machine which is designed to improve material flow in the filling machine while minimizing dust and particle distribution resulting from suspended turbulent air by generating the dust in an area where it may be more easily removed.

Prior art techniques of filling fine powdery materials into bags in a bag filling machine have consisted of filling the bags through a valve bag opening wherein the product is aerated and blown through a tube three to four inches in diameter. This method also results in a dispersal or dusting of the product but not to the same degree as would occur in the use of an open mouth bag. When utilizing such valve bag filling methods, disadvantages are obtained in that the number of bags that can be filled per minute is considerably reduced as a result of the small opening through which the product must flow and the ability of the air to escape from the container into which the product is forced. Higher line speeds have been obtained on valve packing equipment by utilizing multiple spout capabilities with varying degrees of success and with higher additional costs. A further disadvantage of the valve bag filling methods lies in the fact that in order to contain the product within the package, it is necessary to use what is known as a tuck-in sleeve in the valve in order to eliminate sifting of the product from the package after filling.

It has been felt by the applicant that open mouth multi-wall bags may be utilized to alleviate the problems inherent in valve bag filling and would also provide advantages over such filling techniques in that the filling charge may be placed more evenly in the container to be filled since access to the container or bag is through the fully opened mouth of the bag and not through a restricted tube. Further advantages are felt to exist when utilizing a pinch-style open mouth multi-wall bag since such bags are generally provided with sift-proof closures without the need of additional closing capabilities.

The filling of fine powdery materials into open mouth multi-wall bags has not been without problems which are generally related to excessive leakage and dispersion of the product from the filling system. In the prior art of filling open mouth bags, the falling material was allowed to impact at the bottom of the container being filled thereby generating dust in an area very difficult to evacuate. When filling material such as manganese sulfate, several problems occur which must be solved in order that the manganese sulfate be accurately weighed and deposited in the bag that is being filled. The fine powdery materials such as manganese sulfate often flow like water in the transition chutes of standard bag filling machines and cause extreme dust problems and turbulence within the portions of the transition chute and the throat sections of the bag filling machine such that many other problems are encountered in removing the dust that must be met in order to obtain an acceptable filling machine from the customer's viewpoint. Since manganese sulfate does flow like water in the transition chute, its flow must be slowed down and accurately controlled while at the same time being allowed to pass through the transition chute fast enough to meet desired filling flow rates without causing excessive turbulence in the transition chute and generating dust in hard-to-remove areas.

It is known in prior art bag filling machines to provide automatic controls in the hopper to control the flow of material being fed into the bag or container. One such control device is shown in the U.S. Pat. No. 1,397,932, issued to J. B. Mockridge on Nov. 22, 1921, wherein a control device was developed for use with fertilizer and with industries developing more or less sticky materials in the plant. Such a control device, while satisfactory for fertilizer and other materials, would not necessarily be able to be adapted for fine powdery materials such as manganese sulfate or the like.

Other known prior art devices for controlling the flow of material in a transition chute for a filling device are taught in the U.S. Pat. No. 787,396, issued to P. Provost on Apr. 18, 1905, wherein there is taught a conical shaped regulator 14, shown in FIG. 1 of his drawing, with an angular obstruction 20 formed on the bottom of the cone for retarding the flow of grain for which the device was designed. Such conical shaped regulator, while satisfactory for grain would not necessarily be found desirable and satisfactory for use in bagging fine powdery materials such as manganese sulfate of the like. Other bag filling machines have been developed as typified by the U.S. Pat. No. 915,847, issued to P. A. Frye, on Mar. 23, 1909, which utilized conical shape shut-off valves 35, as shown in FIG. 1 of his patent, in combination with a revolving agitator 33 to control the flow of granular material such as flour or sugar. Such a machine as typified in this patent would probably be satisfactory for flour or sugar which would require the use of the revolving agitator but such combinations would not necessarily be required or even helpful in finer powdery substances such as manganese sulfate or the like.

More modern bag filling machines are typified in the U.S. Pat. No. 3,474,836, issued to P. Schwake, et al., on Oct. 28, 1969, wherein there is taught the use of at least two conical valves, shown by the numeral 3 and by the numeral 45 in FIG. 1 of the Schwake patent. The conical valve 45 has been designed to assure a disturbance-free flowing of the material out of the hopper and has been designed to distribute the material so that it emerges from the outlet free from eddie currents. How such distribution is obtained is not entirely explained, however, it is noted that the valve 45 in the patent is not movable in position during the filling operation with any given material which is diametrically opposite to the applicant's control device as will be more fully described hereinafter.

More recent use of conical valves in bag filling machines is also typified in the U.S. Pat. No. 3,578,041, issued to Katsuji Obara on May 11, 1971; and the U.S. Pat. No. 3,707,172, issued to the same inventor on Dec. 26, 1972. Such machines as typified by these two patents appear to utilize cone valves simply as flow control devices and not necessarily as utilized in the applicant's new and novel structure as will be more fully detailed hereinafter.

SUMMARY OF THE INVENTION

In order to overcome the problems inherent in the prior art devices known to the trade and as typified in the beforedescribed U.S. Patents, the applicant's new and novel structure and method makes it possible to control the flow of fine powdery materials into bags and the suspended air and dust to a much greater degree by generating the dust in the upper portion of the transition chute and providing a means for controlling the total energy in motion of the charge as it enters the critical choke area immediately below the transition chute and above the bag to be filled and with the structure providing a means for removing the suspended air and dust.

The applicant's new and novel structure utilizes a control device suspended in the inclined section of the transition chute to absorb energy of the freely falling material in the bag filling machine with the same device serving to control the flow of the material in the transition chute and with the device further having formed on the bottom thereof an elongated divider member which is rigidly attached to the control device and serves to divide the vertical throat section into two flow paths with one flow path being utilized for downward flow of the material being filled in the bag filling machine and the other flow path being used for upwardly flow of the suspended air resulting from the filling process. The flow paths alternate as the material alternately drops first down one side of the chute and then down the other. Means are provided on the elongated divider member for stopping the movement of the divider member at a predetermined position so that the path utilized for upward air flow always remains open regardless of the position of the divider member as it alternates from one side to the other within the vertical throat section. Also provided are means for removing the suspended air and dust from the upper portion of the transition chute and thereby reduce the amount of dust generated in the bag filling area.

Accordingly, it is an object and advantage of the invention to provide a new and novel structure and method which may be incorporated to control the energy of the freely falling material and at the same time reducing the effect of dust within the transition chute of the bag filling machine.

Still yet another object and advantage of the invention is to provide a new and novel structure and method whereby dust generated by the falling material is formed in the upper portion of the transition chute where it can be more easily removed and reduce the amount of dust accumulating in the bottom of the container being filled.

These and other objects and advantages of the invention will become apparent from a review of the drawings of the application and from a reading of the description of the preferred embodiment.

DESCRIPTION OF THE PREFERRED EMBODIMENT

Figure 1:
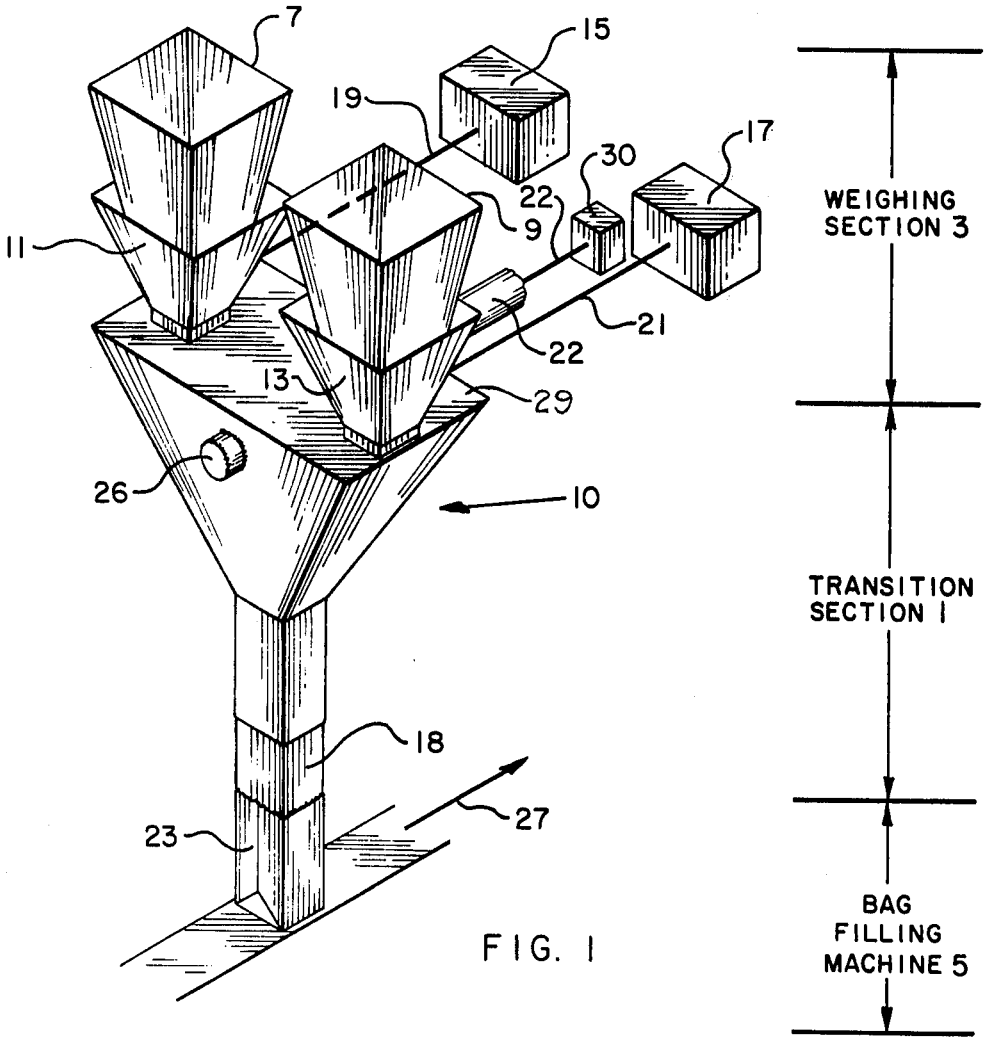
FIG. 1 is an isometric view of the subject device showing its position in relation to the weighing section and the bag filling machine.

Referring now to the drawings in general and in particular to FIG. 1 of the drawing, there is shown an isometric view of the subject device showing its position in relation to the weighing section and the bag filling machine in a bag packaging line. The subject device comprises a new and improved transition section 1 which is positioned between an existing weighing section 3 and the bag filling machine 5. The standard weighing section 3 would comprise a plurality of material hoppers 7 and 9 which receive the material to be weighed for deposit in a plurality of weighing hoppers 11 and 13 which are suspended below the material hoppers 7 and 9 and are carried by the weighing scales 15 and 17 by means of the weighing arms 19 and 21.

In the weighing process the material being weighed is ultimately dumped into the transition section 1 as the weighing scales 15 and 17 alternately weigh the material and allow it to be dumped into the transition section. As a result of this alternate dumping, the material to be packaged in the bag filling machine 5 is alternately dropped into the transition section 1 first from the weighing hopper 11 on the left of the device and then from the weighing hopper 13 on the right of the device and thereafter alternating back and forth between the two weighing hoppers. The material then passes through the transition section 1 which will be described more fully hereinafter, to the bag filling machine 5 which is designed to place a bag 23 in close proximity to the throat 18 of the transition section 1 for the purpose of filling the bag and then moving the bag in the direction shown by the arrow 27 to be ultimately shut by a closing machine in the packaging line.

Due to the length of the transition section 1 between the weighing section 3 and the bag filling machine 5 it can be readily seen that the material to be packaged must ultimately drop a given distance creating extreme conditions of dust and entrapped air within the system which it would be desirable to eliminate in order to have a relatively pollution-free atmosphere in the proximity of the bag packaging line. The applicant's new and noval improved transition section 1 deals directly with that problem as will be more fully described hereinafter.

Figure 2:
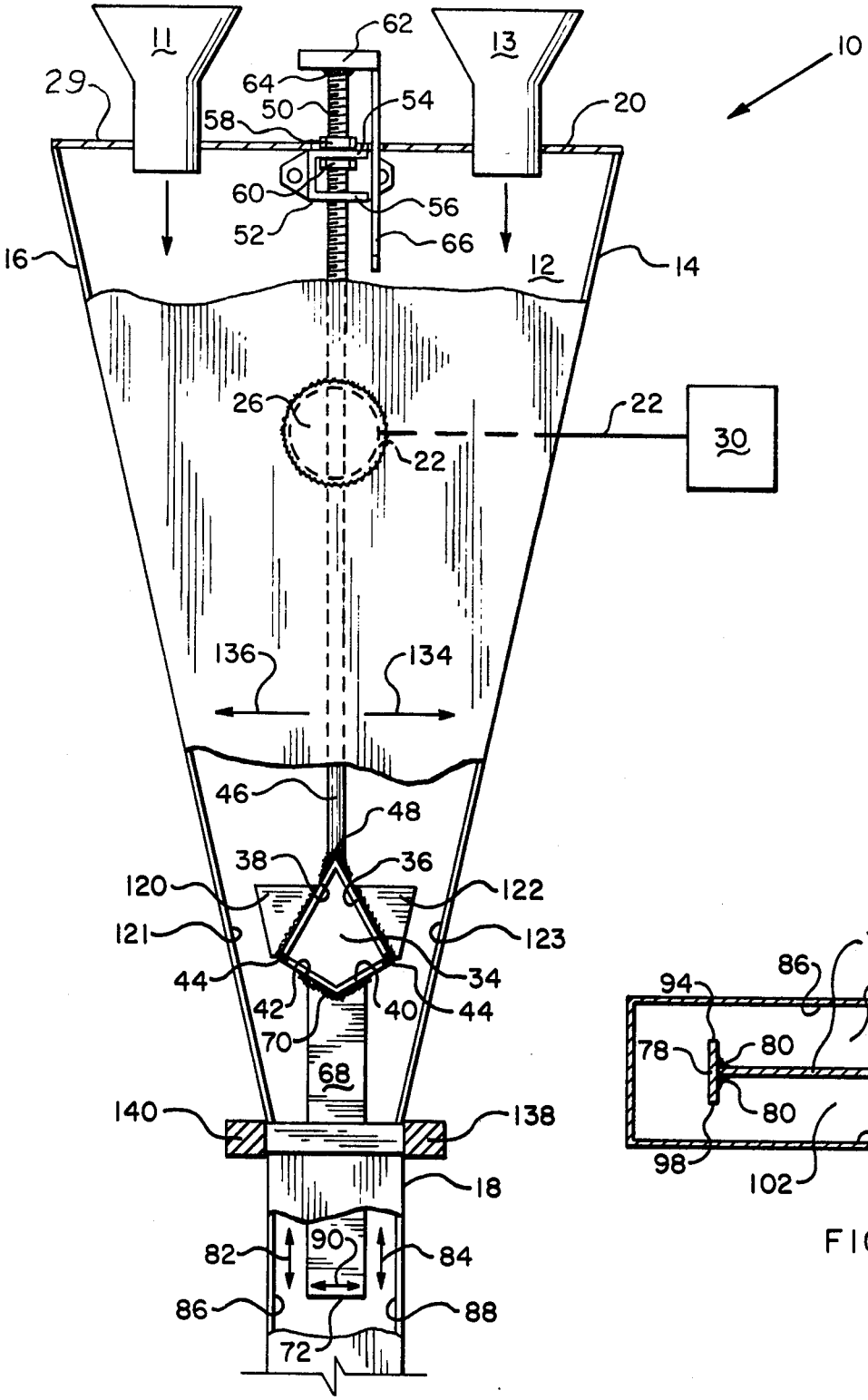
FIG. 2 is an end view of the subject new and novel structure shown partially in section and showing the control device and divider member suspended within the transition chute of the subject invention.
Figure 3:
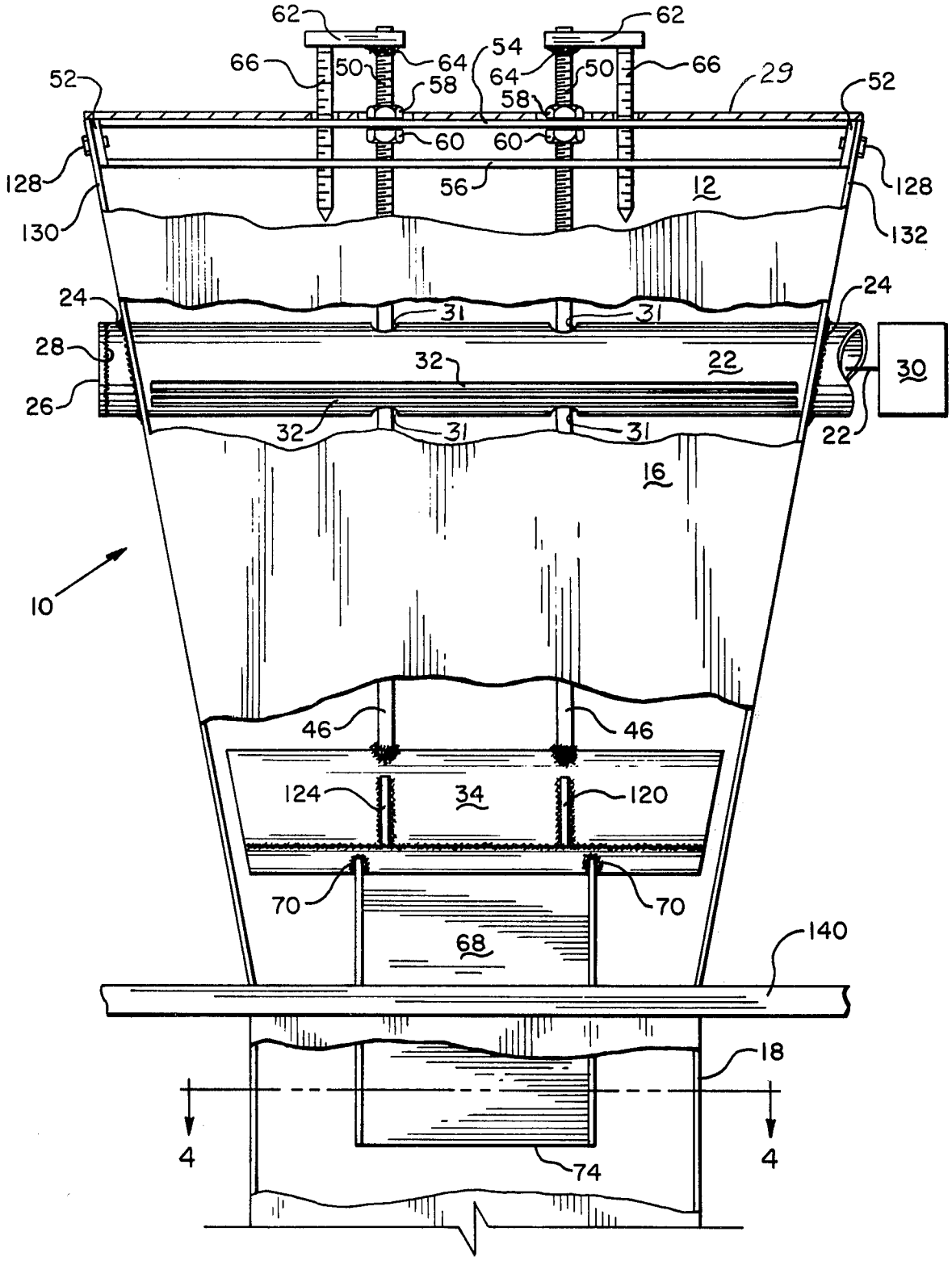
FIG. 3 is a side view of the new and novel device shown partially in section.

Referring now to FIGS. 2 and 3 of the drawing there are shown views of the subject invention shown generally by the numeral 10 which comprise a transition chute 12 which is formed with downwardly and inwardly sloping sides or sections 14 and 16 which terminate in a substantially vertical elongated tubular throat section 18.

The upper edge 20 of the transition chute 12 with lid 29 attached would be positioned below the weighing hoppers 11 and 13 in a standardized type of weighing operation and would be designed to receive a predetermined amount of material which has been properly weighed by known weighing means and to convey the material to the standard bag filling machine 5 below. The weighing operation and structure which would be positioned above the upper section 20 of the transition chute 12 is not shown in the drawing FIG. 2 for purposes of clarity but is shown in isometric form in FIG. 1 of the drawing. The lid 29 prevents dust from circulating outside of the transition chute 12.

The transition chute 12 has positioned in the central position thereof a removing means 22 in the form of a circular duct which is positioned through the sides 14 and 16 and is held in place thereto by means of a weld 24. One end of the circular duct or removing means 22 is enclosed by means of the circular plate 26 which may also be retained in place by means of the weld 28 as is well known in the art of welding. The other end of the circular duct 22 would be connected to an exhaust fan shown diagrammatically in block form by the numeral 30. The exhaust fan 30 would be interconnected to the bag filling machine in such a manner as to be able to control the exhaust from the central portion of the transition chute 12 as may be desired by the operator of the device.

The circular duct 22 has formed in the lower portion thereof within the confines of the transition chute 12, a plurality of elongated slits 32 through which suspended particles of dust and air may pass as the exhaust fan 30 evacuates the central portion of the transition chute 12. The size of the elongated slits 32 and the number of elongated slits 32 formed in the bottom portion of the circular duct 22 may be determined by experimentation taking into account the total amount of air and dust to be evacuated from the transition chute 12 and taking into account the size of the exhaust fan 30.

The prior art bag filling machines had no provisions for removal of air and dust in the upper portions of the transition chute. Consequently, dust generated by the falling material was increased in the area of the bag and was difficult to remove.

Suspended in the lower portion of the transition chute 12 is a control device 34 which is formed in the general shape shown in FIG. 2 of the drawing and comprises a pair of side plates 36 and 38 as well as a pair of bottom plates 40 and 42 which are rigidly attached to the side plates 36 and 38 by means of a weld 44 as is known in the welding art. The side plates 36 and 38 may be formed of two separate pieces or may be formed in one piece and bent to the configuration shown in FIG. 1 of the drawing. In a similar manner, the bottom plates 40 and 42 may be formed of two separate pieces or may be formed in a one-piece construction and bent in the configuration shown in FIG. 2 also. The control device 34 is suspended within the lower portion of the transition chute 12 by means of an elongated rod 46 which is welded to the control device 44 by means of the weld 48 and passes through enlarged holes 31 in the circular duct 22.

The upper end of the elongated rod 46 is threaded as shown by the numeral 50 and is carried by a support bracket 52 of the configuration shown in FIGS. 2 and 3 of the drawings. The support bracket 52 receives the threaded end 50 of the elongated rod 46 through a pair of holes, not shown in the drawing, in the opposed plates 54 and 56 and the elongated rod 46 is then movable vertically within the holes and may be rigidly fixed at a desired location by means of a plurality of nuts 58 and 60. After the elongated rod 46 has been moved to a predetermined position, the nuts 58 and 60 can be tightened down on the plate 54 to rigidly retain the elongated rod 46 in a given position.

In order to visually observe the position of the elongated rod 46 in the transition chute 12, there is provided a horizontal plate 62 which is welded to the threaded portion 50 of the elongated rod 46 by means of the weld 64. The plate 62 then has fastened thereto by means well known in the art an elongated downwardly pointing ruler 66 which would have appropriate increments marked on the side of the ruler to permit quick visual observation of the location of the elongated rod 46 in the transition chute 12.

Referring now to the lower portion of the transition chute 12 as shown in FIG. 2 of the drawing there will be described in somewhat more detail the function of the control device 34 in the operation of the improved structure shown in the drawing. The purpose of the control device 34 is to serve to absorb energy of the material flowing through the transition section 1 as the material falls in the transition chute from the weighing section 3 to the bag filling machine 5. In addition the control device 34 serves to control the flow of material in the transition chute in order that the flow through the chute and through the throat section 18 is controlled thereby controlling the dust within the interior portion of the transition chute 12 and generating the dust in an area where it is more easily removable.

It can be seen from referring to FIG. 2 of the drawing that the control device 34, being suspended from the elongated rod 46 is movable in a generally horizontal direction within the inclined portion of the transition chute 12 since the rod 46 has sufficient flexibility to allow this movement. The movement of the control device 34 within the transition chute 12 will be described more fully hereinafter after a brief description is given of the remaining parts of the structure attached to the control device.

Rigidly fastened to the bottom plates 40 and 42 of the control device 34 is an elongated divider member 68 which is welded at the upper end thereof, by means of the weld 70, to the bottom plates 40 and 42 and has its lower portion 72 positioned within the throat section 18. Since the divider member 68 is welded to the control device 34 it becomes readily apparent that the divider member 68 is also movable in a horizontal direction as the control device 34 moves as will be described more fully hereinafter. By referring to FIGS. 3 and 4 of the drawing it can be seen that the divider member 68 may be formed in a generally I-shaped construction having a central web portion 74 and two perpendicular end plates 76 and 78 which are welded to the web portions 74 by means of the weld 80. When formed in this manner, the divider member 68 then forms at least two flow paths within the throat section 18, with one flow path being utilized for a downwardly flow of the material being filled in the bag filling machine and the other flow path being utilized for upwardly flow of suspended dust and air resulting from the filling process. The flow paths are seen in FIG. 2 of the drawing in the throat section 18 and are shown by the arrows labeled 82 and 84. The formation and the use of these flow paths 82 and 84 in the applicant's new and noval structure will be described more fully hereinafter and it is sufficient to say at this point that the flow paths serve as a means for allowing the material to be bagged to reach the bag and simultaneously to allow suspended dust and air to be removed upwardly through the structure by means of the exhaust fan 30 through the circular duct 22 without any choking off of the flow of suspended dust and air.

The end plates 76 and 78 of the elongated divider 68 also serve as a means for stopping the movement of the divider member at a predetermined position so that the path utilized for upward air flow always remains open regardless of the position of the divider member in the throat section. This stopping means results from the use of the end plates 76 and 78 which will strike the inside portions of the throat section 18 at the points numbered 86 and 88 in FIG. 2 of the drawing whenever the divider member 68 moves in the general direction shown by the arrow 90 as will be described more fully hereinafter. As a result whenever the ends 92 and 94 of the end plates 76 and 78 strike the insides of the throat section 18 at the point 86 it can be seen that the space between the web 74 of the divider member 68, shown by the numeral 100, is kept open thereby assuring passage of either flowable material or suspended air and dust in that section depending upon the position of the divider member. In a similar manner whenever the ends 96 and 98 of the end plates 76 and 78 strike the other side of the throat section 18 at the point 88 the opened portion between the web 74 and the ends 96 and 98, shown by the numeral 102 form another passage which is always kept open regardless of the position of the divider member.

Figure 5:
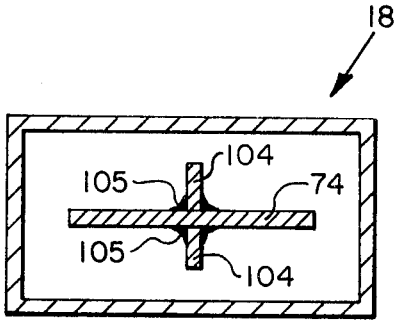
FIG. 5 is a sectional view taken along line 4—4 of FIG. 3 of the drawings showing a modification of the preferred embodiment.
Figure 6:
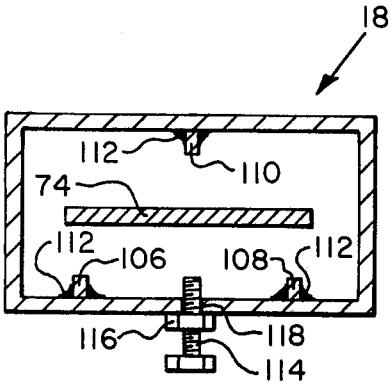
FIG. 6 is another sectional view taken along line 4—4 of FIG. 3 of the drawings showing a further modification of the preferred embodiment.
Figure 4:
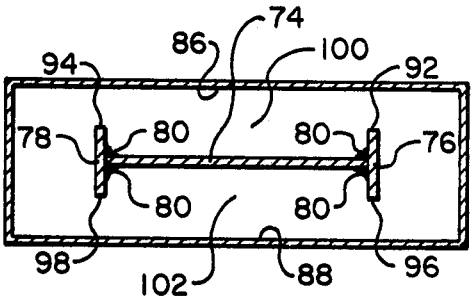
FIG. 4 is a sectional view taken along line 4—4 of FIG. 3 of the drawings.

The stopping means of the subject invention may be formed as shown in FIG. 4 of the drawing and may also be formed in another embodiment as shown in FIG. 5 of the drawing wherein there is formed on the web portion 74 of the divider member 68 at least one rigid plate 104 that may be rigidly attached to the web 74 by means of the weld 105. The use of at least one rigid plate formed thusly would probably dictate that the rigid plates be positioned in the central portion of the web 74 as shown in FIG. 4 of the drawing. In addition, the rigid plate stops may be formed as shown in FIG. 6 of the drawing and may comprise a plurality of plates 106 and 108 of a singular plate 110 all of which are welded to the throat section 18 by means of the weld 112. It may also be desirable to provide a stopping means that is adjustable in which case the stopping plates 106, 108, or 110 may be replaced by a series of adjustable stops being formed on and positioned on the inside of the elongated tubular throat section 18. The adjustable stops may take the form of a threaded bolt 114 utilized in combination with a tightening nut 116 with the bolt 114 being screwed in place into a drilled and tapped hole 118 formed through the throat section 18.

When formed thusly the adjustable stops would be able to be precisely positioned to allow the divider member 68 to move as close as desired to the sides of the throat section 18 without entirely blocking off the flow of material or suspended air and dust through that section.

There may also be provided, in one form of the invention, a restraining means for restraining the movement of the control device 34 after a predetermined motion with the restraining means being rigidly fastened to the control device 34. When formed thusly, the restraining means may be formed of a plurality of rigid plates 120, 122, 124 and 126. The plates 120 and 122 are shown in FIG. 2 of the drawing and the plate 124 is shown in FIG. 3 of the drawing with the plate 126 being behind plate 124 in FIG. 3 of the drawing but being in a location similar to the location of the plate 122. While in the preferred embodiment the restraining means is shown as at least two plates fixedly attached to the control device 34 it is within the spirit and scope of the invention that the restraining means could also comprise at least one elongated vertically positioned plate being fixedly attached to the control device as for example being positioned in the central portion of the control device and extending from one side to the other. In a similar manner, the one elongated vertically positioned plate may also be welded to the end of the control device 34 within the spirit and scope of the invention. It can be seen that the restraining means serves to control the extent of travel of the control device 34 by hitting on the sides of the inclined section of the transition chute at the points numbered 121 and 123 as shown in FIG. 2.

Referring now to FIG. 3 of the drawing there is shown how the support brackets 52 are retained on the transition chute 12 in the upper portion of the transition chute. The brackets 52 are retained in position by means of the screws 128 which are positioned in the ends 130 and 132 of the transition chute 12 and span across the top of the transition chute to serve to support the elongated rods 46 which carry the control device 34 as has been before described. While in the preferred embodiment shown in FIGS. 2 and 3 of the drawing the control device is suspended from two flexible rods 46 it is within the spirit and scope of the invention that the control device 34 may also be suspended from at least one flexible rod from within the transition chute so that it is movable in a segmental arc within the transition section on that singular rod.

Referring now back to FIG. 2 of the drawing there will be described in some detail the operation of the control device 34 and how it moves in a generally horizontal direction as the material being weighed is released from the weighing hopper and is transferred through the transition chute to the bag filling machine. As has been described before, the weighing hoppers 11 and 13 alternately weigh material to be packaged and alternately discharge the material into the transition chute 12. When a predetermined charge from weighing hopper 11 is deposited into the transition chute 12 it rapidly flows downwardly in the transition chute until it strikes the control device 34 on the side plate 38 moving the control device 34 to the right in the direction shown by the arrow 134 until either the restraining means in the form of the plate 122 strikes the point 123 on the inclined side of the transition chute or until the end plates 76 and 78 of the divider member 74 strike the point numbered 88 in the throat section 18. The enlarged holes 31 are sized so that the rod 46 does not strike the duct 22 when the rod moves. The control device 34 breaks the fall of the material and thusly aids in controlling the flow of the material. Since the elongated rod 46 is suspended in the transition chute and is restrained at its upper end by the nuts 58 and 60, it can be seen that the flexibility of the elongated rod 46 will allow the control device 34 to move and remain in an off-centered position as long as the materials are flowing from the weighing hopper 11 down the transition chute 12. As this occurs, it can be readily seen an upward air and dust passage is retained in the narrow restricted throat section 18 as shown by the arrow numbered 84 thereby allowing the suspended air and dust to be removed upwardly to the right side of the transition chute into the elongated slits 32 and out through the exhaust fan 30 and more easily removed as has been described before. When the weighing hopper 11 has discharged its entire contents into the transition chute then the weighing hopper 13 would commence discharging its contents into the transition chute causing the contents to drop downwardly in the chute and strike the control device 34 on the side plates 36 which would then send the control device to the left in the direction shown by the arrow 136. The control device and elongated divider member would then remain off-center in the left position as long as particles from the weighing hopper 13 continue to strike the control device. It can also be seen that when the control device is in the left position as shown by the arrow 136 that the suspended air and dust will then be able to be evacuated upwardly through the air passage formed in the throat section and shown generally by the arrow 82 and out the exhaust fan 30.

Thereafter, the control device 34 moves back and forth from the left to the right in the transition chute as the weighing hoppers 11 and 13 alternate in depositing material through the transition chute into the bag filling machine. The control device 34 thereby serves to break the fall of the flowing material in the transition chute with the falling material serving to shift the position of the control device in such a manner as to open a greater flow path for the flow downwardly of the material while at the same time retaining an upwardly opened flow path for flow of suspended air and dust out of the system thereby resulting in a much improved transition section for use with a bag filling device.

The transition chute 12 may be supported between the weighing section 3 and the bag filling machine 5 by means of the elongated horizontal members 138 and 140 which retain the transition chute 12 in its desired position and which are ultimately fastened to the frame of the bag filling machine or to a separate free standing frame. The transition chute as well as the structural parts forming the control device portion including the elongated rod and the divider member may be formed of steel in the preferred embodiment and may also be formed of stainless steel when it is desired to provide that type of installation. It is also within the spirit and scope of the invention that the new and novel transition section may also be formed of other materials in keeping with the particular type of material to be packaged in the bag filling machine.

From the above it can be seen that there has been provided an improved transition section for a bag filling device which comprises a new and novel transition structure that can be effectively utilized to absorb the energy of the material passing through the bag filling machine and to effectively control the flow of the material in the transition section so that at least two flow paths are formed within the transition chute throat section with one throat path being utilized for a downwardly flow of material and the other flow path being utilized for an upwardly flow of suspended air and dust with the flow paths alternating as the control device moves back and forth in the transition section. There has also been provided by the subject invention a means whereby the dust created by the impact of the downwardly falling material can be effectively evacuated in the upper portion of the transition chute where it can be readily removed. It should become apparent from a review of the drawings and a reading of the specification of the subject invention that many changes may be made in the arrangement of the parts and the location of the parts in the structure without departing from the spirit and scope of the invention and the invention is not to be limited to the exact structure shown in the preferred embodiment which has been given by way of illustration only.

Having described out invention, we claim:

1. In a bag filling machine having a weighing section with alternately discharging weighing hoppers disposed in communication with respective opposite sides of a bag filling section by means of an intermediate transition section, the improvement which comprises in combination:

a. said transition section having a chute projecting downwardly with a portion thereof inclined inwardly, and terminating in a substantially vertical elongated throat section defining the bag filling section;

b. a control device, means for suspending the control device in said inwardly inclined portion of the chute, said control device having means permitting movement thereof in a generally horizontal direction within said inwardly inclined portion of the chute in response to alternate discharge of the weighing hoppers, said control device serving to absorb energy of the material flowing in the filling machine as it falls in the transition section and also serving to control flow of the material in the transition section, said control device serving also to allow dust to be generated in the upper portion of the transition section where it can be readily removed;

c. an elongated divider member rigidly attached to said control device at one end thereof and extending into said vertical elongated throat section a predetermined distance, said divider member being also movable in a generally horizontal direction as said control device moves, said divider member defining in cooperation with inner surfaces of said vertical elongated throat section at least two flow paths within said vertical elongated throat section, one flow path being utilized for downwardly flow of the material being filled in the bag filling machine and another flow path being utilized for upwardly flow of suspended dust and air resulting from the filling process;

d. means, associated with said divider member and said throat section, for stopping the movement of said divider member at a predetermined position so that the path utilized for upward air flow always remains open regardless of the position of said divider member; and e. means, associated with said transition chute, for removing the suspended dust from the transition chute.

2. The structure as defined in claim 1 wherein said control device is suspended from the upper portion of said transition section and is suspended from at least one elongated rod.

3. The structure as defined in claim 2 wherein said control device has means movable a predetermined amount in a generally vertical direction.

4. The structure as defined in claim 1 wherein said elongated divider member is formed of a metallic plate welded to the bottom of said control device.

5. The structure as defined in claim 1 wherein said stopping means comprises at least one rigid plate fixedly attached to the bottom of said elongated divider member for engagement with the elongated throat section.

6. The structure as defined in claim 1 wherein said stopping means comprises a plurality of stops being formed on the inside of said elongated throat section in proximity to the bottom of the elongated divider member.

7. The structure as defined in claim 1 wherein said stopping means comprises a plurality of adjustable stops being formed on the inside of the elongated throat section in proximity of the bottom of the elongated divider member.

8. The structure as defined in claim 1 further comprising means, associated with said control device and said transition section for restraining the movement of the control device after a predetermined motion.

9. The structure as defined in claim 8 wherein said restraining means comprises at least one elongated vertically positioned plate being fixedly attached to said control device.

10. In a bag filling machine having a weighing section with alternately discharging weighing hoppers disposed in communication with respective opposite sides of a bag filling section by means of an intermediate transition section for controlling a plurality of material flows into an opened bag by means of a control device, the improvement comprising in combination:

a. means including at least one flexible rod for suspending the control device within the transition section so that it is movable in a segmental arc within the transition section in response to alternate discharge of the weighing hoppers, said control device serving to absorb energy of the material flowing in the filling machine as it falls in the transition section and also serving to control flow of the material in the transition section, said control device serving also to generate dust in the upper portion of the transition section where it can be readily removed;

b. a movable rigid plate member being formed on the bottom of the control device, said plate member defining in cooperation with inner surfaces of the transition section, at least two flow paths, one of the flow paths serving as a way to release suspended dust and air resulting from the filling process upwardly, the other of the flow paths serving as a path for downwardly flow of the material;

c. at least one stopping means being associated with said plate member and an inner surface of the transition section for stopping the motion of said plate member at a predetermined position whenever said control device and said plate member move a predetermined distance relative the inner surface of the transition section; and d. means, associated with said transition section, for removing the suspended dust from the transition section.

11. The improvement as defined in claim 10 wherein said control device has means adjustable vertically a predetermined amount on the flexible rod.

12. The improvement as defined in claim 10 further comprising a restraining means being associated with said control device for restraining the motion of the control device at a predetermined position whenever the control device moves.

13. The improvement as defined in claim 12 wherein said restraining means comprises at least one vertically positioned plate member being formed on said control device.

14. The improvement as defined in claim 10 wherein said stopping means comprises at least one vertically positioned plate member being formed on the bottom of said movable rigid plate member.

15. A method for controlling the amount of dust in a transition section of a material packaging line between a pair of weighing hoppers and a bag filling machine comprising the steps of:

a. providing a control device for the central portion of the transition section;

b. providing a divider member for the control device;

c. suspending and attaching the divider member on the control device;

d. suspending and attaching the control device with divider member attached within the central portion of the transition section;

e. dropping a predetermined amount of material from one weighing hopper into the transition section and onto the control device causing said device to restrain the flow of material, said control device and said divider member being disposed for movement in a predetermined distance in one direction to create a downwardly flow path for the material and an upwardly flow path for suspended dust and air from a bag being filled, said dropping also serving to generate dust in the upper portion of the transition section;

f. dropping a predetermined amount of material from the other weighing hopper into the transition section after the entire predetermined amount of material has been dropped in step (e) and onto the control device causing said device to restrain the flow of material, said control device and said divider member being disposed for movement in a predetermined distance in the opposite direction to create a downwardly flow path for the material and an upwardly flow path for the suspended dust and air from the bag being filled, said dropping also serving to generate dust in the upper portion of the transition section;

g. alternating steps (e) and (f) thereafter to cause the control device to alternate direction of movement in the transition section until the bag being filled has a desired amount of material placed therein;

h. controlling the degree of travel of the control device by means in cooperation with the inner surfaces of the transition section to assure that the air flow paths will always remain open; and i. removing the suspended dust from the transition section to thereby control the dust in the transition section.

* * * * *

UNITED STATES PATENT OFFICE

CERTIFICATE OF CORRECTION

Patent No. 4,049,028 Dated September 20, 1977

Inventor(s) Harris et al

It is certified that error appears in the above-identified patent and that said Letters Patent are hereby corrected as shown below:

Column 4, Line 44, delete "noval" and insert in place thereof -- novel --.

Column 4, Line 68, delete "position" and insert in place thereof -- portion --.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*